United States Patent [19]

Galvez-Moran

[11] Patent Number: 4,917,236

[45] Date of Patent: Apr. 17, 1990

[54] DECORATIVE MATCH BOOK TYPE ASSEMBLY AND PHOTOGRAPHIC DISPLAY

[75] Inventor: Arnoldo Galvez-Moran, Guatemala City, Guatemala

[73] Assignee: World Graphic Resources, Inc., Guatemala City, Guatemala

[21] Appl. No.: 233,416

[22] Filed: Aug. 18, 1988

Related U.S. Application Data

[63] This is a continuation-in-part application of Ser. No. 128,252, Dec. 3, 1987, for a Match Book Assembly, abandoned.

[51] Int. Cl.[4] ..... A24F 27/00

[52] U.S. Cl. ..... 206/102; 206/103; 206/96; 206/457

[58] Field of Search ..... 206/96, 102–106, 206/112, 114, 137, 457, 459

[56] References Cited

U.S. PATENT DOCUMENTS

| | | | |
|---|---|---|---|
| 1,968,353 | 7/1934 | Potter | 206/103 |
| 2,042,584 | 6/1936 | Bustamante | 206/104 |
| 2,116,231 | 5/1938 | Beyer | 206/106 |
| 2,254,968 | 9/1941 | Lebrenz | 206/103 |
| 2,279,893 | 4/1942 | Ross et al. | 206/103 |
| 2,737,290 | 3/1956 | Volckening et al. | 206/104 |
| 3,438,486 | 4/1969 | Pinkas | 206/104 |
| 4,006,819 | 2/1977 | Elliott | 206/104 |

FOREIGN PATENT DOCUMENTS

| | | | |
|---|---|---|---|
| 1362079 | 4/1964 | France | 206/103 |
| 1464118 | 12/1966 | France | 206/104 |
| 12492274 | 8/1967 | France | 206/103 |

*Primary Examiner*—David T. Fidei
*Attorney, Agent, or Firm*—Malloy & Malloy

[57] ABSTRACT

A match book type assembly including two side flaps movably interconnected to one another by a base portion wherein the outer surfaces of both side flaps are dimensioned and structured to respectively include a decorative photograph and advertising or like indicia thereon and further wherein the base portion is disposed and configured to maintain the assembly in an upright orientation for viewing of the photograph and advertising most efficiently when the assembly is in a closed, protective position relative to a plurality of items such as matches or sticks of chewing gum fastened to the housing and disposed within it.

10 Claims, 2 Drawing Sheets

"S"

DECORATIVE MATCH BOOK TYPE ASSEMBLY AND PHOTOGRAPHIC DISPLAY

This is a continuation-in-part application of Ser. No. 128;252, filed Dec. 3, 1987 for a MATCH BOOK ASSEMBLY, now abandoned.

BACKGROUND OF THE INVENTION

1. Field of the Invention

This invention relates to a match book type assembly including a housing for the protective covering of a plurality of items such as matches wherein the housing includes prominently displayed outer surface portions thereof covered by a photograph and/or advertising indicia and a base portion dimensioned and disposed to orient the housing in an upright position for viewing of the prominent surface areas especially when the housing is in a closed position.

2. Description of the Prior Art

Coverings, housings, and like protective assemblies used to cover, for example, matches have been known in the prior art for many years. Typically, the structure known as "match books" are relatively small in configuration and intended to be "pocket sized." Such variable match book type assemblies generally comprise a stiff paper or like foldable material housing of somewhat minimal size greater than a supply of matches or other type items themselves. The housing is positionable between an open and closed position to respectively provide access to the items in the housing for removal thereof or protection thereof during carrying.

Where the items in the assembly are matches, a scratch or striking surface is normally provided on the exterior of the housing and formed from a generally abrasive or like applicable material to provide moving contact with the ignitable match head and ignition thereof. While the above set forth structure is applicable for its intended function, such function is normally directed towards the adequate protection of matches when carried in the pocket or on the person of the user.

The extensive use of matches in today's society, even with the advent of small, inexpensive portable lighters, suggest a need for an improved match book assembly which, while not necessarily designed to be carried on the person, may be specifically structured, configured and dimensioned for display such as on a table, desk or other likely accessible area. While advertising is a common addition to the exterior surfaces of prior art match book type structures, such advertising is generally less than totally effective and lacks a quality aesthetic appearance due in large part to the inexpensive material from which the match book covers are generally made as well as the relatively small size of such match books.

Accordingly, there is a need in the prior art for an improved match book type assembly capable of being oriented in a substantially upright position when supported on a desk, table top, or like supporting surface. Further, when in such upright position, exposed outer surfaces of the improved match book type assembly should be structured and/or used for mounting of quality, highly decorative and aesthetically pleasing advertising or other applicable decorative coverings. In addition, while the size of the improved match book assembly may be significantly greater, such enlarged size does not necessitate the corresponding lengthening of the matches contained within the subject match book assembly. The smaller or "normal" size matches are recognized as being easier to handle and in some instances safer.

Summary of the Invention

The present invention relates to a match book type assembly capable of being positioned between an open position and a closed position in order to respectively provide access to items, such as matches, mounted on the interior of a housing of the carrier assembly and to protect the items for carrying. More specifically, the housing of the subject match book type assembly comprises a mounting portion at least partially surrounding and secured to the base of a plurality of items, such as matches, disposed in an immediately adjacent relation to one another and preferably arranged in at least one or a plurality of rows extending along the length of the housing and disposed on the interior thereof. The housing further includes a first flap having one longitudinal end secured to the mounting portion and extending outwardly therefrom into engagement along its opposite longitudinal end with a base portion of the housing. The housing comprises a second side flap interconnected to the first side flap by the base portion and extending from the base portion back towards the mounting portion. The second side flap includes a free longitudinal edge selectively positionable into retained or detached relation to the mounting portion to respectively define a closed and an open position. The first side flap, base portion and second side flap are movably secured to one another for selective positioning between the open and closed position. The open position is of course defined by displacement of the first flap out of overlying or covering relation to the plurality of matches so as to provide access thereto and manual removal of one or more items from the secured row of plurality of items, for example, sticks of gum or matches.

An important feature of the present invention is the provision of a prominent, exposed and viewable outer surface on the first side flap and the second side flap. One of such outer surfaces is covered, substantially in its entirety, with a photograph of any aesthetically pleasing or desired scene, thereby adding a unique decorative appearance to the match book type assembly when such is displayed on a desk, table top, or like supporting surface in a position for ready access. The other outer surface of the first and/or second side flap may be covered with a decorative or advertising indicia substantially over the entire exposed portion thereof. The base portion is disposed in interconnecting relation between the first side flap and the second side flap and comprises a substantially flat or planer orientation being dimensioned to adequately support the housing of the match book type assembly in an upright orientation such that both outer surfaces of the first and second side flaps are prominently displayed for viewing of the photograph on one side and the advertising or decorative indicia on the other.

In the aforementioned upright orientation, the plurality of items, such as matches, are disposed in an inverted position on the interior of the housing and spaced from the base portion, especially when it is desired to maintain the longitudinal dimension of the items, especially if matches, significantly smaller than the transverse dimension of the housing when in its closed position.

In one embodiment of the present invention where matches are in the assembly, a scratch or abrasive surface serving to movably engage the match heads may be formed along the entire or partial length of the base in a removed position from the contained and enclosed matches when the subject housing is disposed in the aforementioned closed position.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

Detailed Description of the Preferred Embodiment

Figures 1, 2, 3:
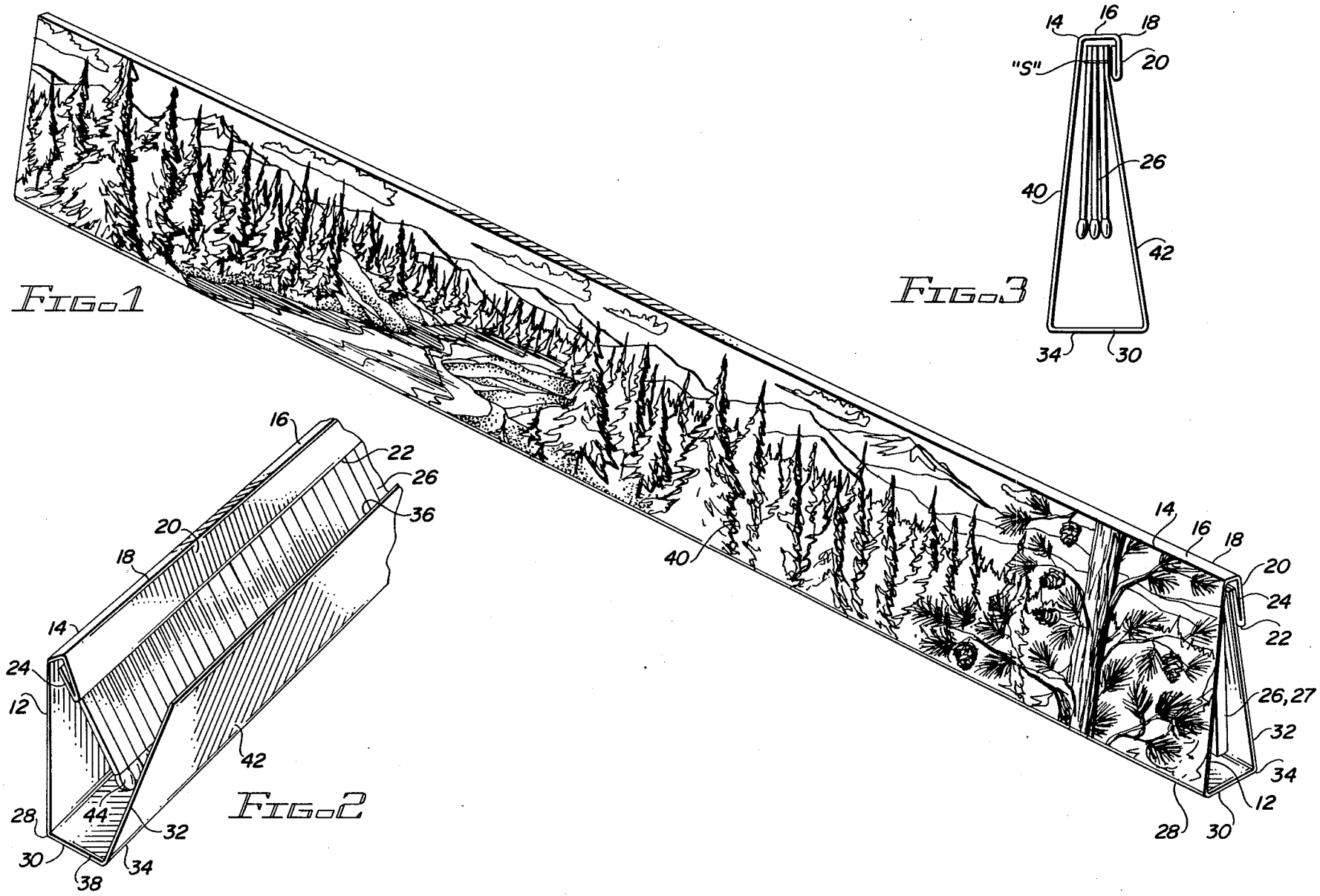
FIG. 1 is a perspective view of the structure of the present invention illustrating the match book type assembly in a closed position.
FIG. 2 is a semi-open perspective view of the embodiment of FIG. 1, wherein the items in the housing are matches.
FIG. 3 is an end view of the embodiment of FIGS. 1 and 2.
Figures 4, 5:
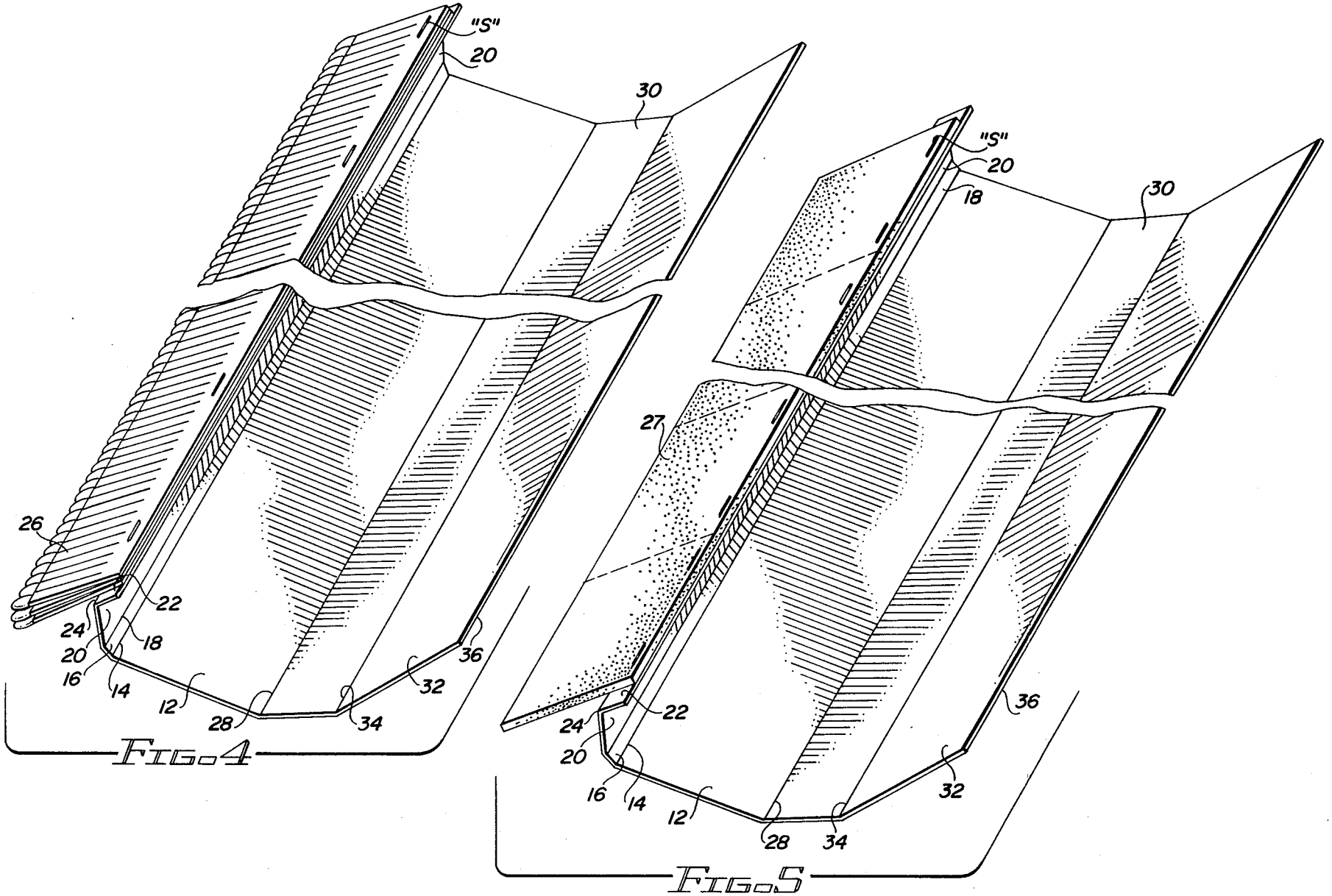
FIG. 4 is a fully opened view of the embodiment of FIG. 1.
FIG. 5 is the same as FIG. 4 but with a different kind of item on the housing, such as sheets of candy.

The present invention may be considered to be a triangle decorative panoramic self-supporting carrying advertising case, in this document identified as TDPSSCAC, indicated in FIG. 1 having a substantially enlarged and elongated configuration compared to any others existing in the market. In a preferred embodiment, it may be about 16 inches in length and about 2 ¾ inches in height.

The assembly shown in FIGS. 1 and 2 comprises a housing which is defined by a first side flap 12 having in its upper end a longitudinal edge 14 which interconnects it with another flap 16. This flap 16 is interconnected by another longitudinal edge 18 to flap 20 at the end of which there exist another longitudinal edge 22 to connect flap 20 with flap 24. This flap 24 is used to support the products held by it, in such a way that it is not possible to see how the products are fastened to it when the assembly or TDPSSCAC is closed. The plurality of products 26 or 27 are arranged in side-by-side substantially adjacent relation to one another and are collectively formed into at least one or a plurality of rows extending between opposite ends along the length of the housing as clearly shown.

The first side flap 12 has its opposite longitudinal edge as at 28 secured to a base portion 30 which is oppositely disposed to the mounting portion 16. A second side flap 32 has a correspondingly positioned longitudinal edge 34 also secured to the base portion 30 such that the base portion 30 serves to movably interconnect the first side flap 12 to the second flap 32 as shown. The second side flap 32 has an oppositely disposed free longitudinal edge 36 which is selectively positionable into and out of retained underlying relation to the retaining flap 24 which is part of the flaps 16 and 22.

Accordingly, it should be readily apparent that the housing may be disposed between a closed position, the free longitudinal edge 36 of the second flap 32 being disposed in underlying and retaining relation to the retaining flap 24. Alternately, the housing may be positioned in an open position as shown in FIG. 2, so as to provide access to the plurality of products 26 or 27 and remove one or more. In the case of matches 26 its ignition is readily accomplished by frictionally sliding or moving the match head 44 of any of the matches 26 along a scratch surface 38 extending at least partially but preferably along the entire length of the exterior base portion 30. The scratch surface 38 is of course made from an abrasive or friction producing surface relative to the sliding of the match head 44 along the length thereof. Naturally, the scratch surface 38 is located on the exterior of the housing and in a removed location relative to the containment or storage of the plurality of matches 26 on the interior of the housing between the first side flap 12 and the second side flap 32.

It should be noted that the transverse dimension of the base portion 30 is such as to provide an adequate support surface to maintain the housing in a substantially upright position as shown in FIG. 1, especially when the housing is in its closed position as defined above. Therefore, when the housing is in its closed position, the first and second side flaps respectively, are angularly oriented relative to one another and extend from their connection with the mounting portion in an angularly substantially divergent configuration to the base portion. The relative angular orientation of the first and second side flaps is due to the fact that the base portion has a significantly larger transverse dimension than that of the mounting portion to provide the aforementioned support and upright orientation of the housing. Preferably the distance across the base portion is about at least one inch to provide an elongated support surface for the assembly.

Such upright orientation is preferable and desired so as to adequately and prominently display the outer surfaces of the first side flap of the second side flap 26. In order to improve the aesthetic appearance as well as add additional commercial value to the match book type assembly, the outer surface of at least one, but preferably the first side flap, may have mounted thereon a photograph. The photo is dimensioned to substantially cover the entire exposed or outer surface for easy viewing when the housing is maintained in the above-defined upright orientation.

Similarly, the exposed surface of the second side flap may be entirely or at least partially covered by a decorative indicia or by advertising or any applicable indicia means as desired. The upright orientation as defined above efficiently and prominently displays both the outer surface and the outer surface of the first side flap and the second side flap 26 respectively.

It should further be noted that even though the housing of the subject assembly is significantly larger than a conventional "pocket-sized" match type pack, the individual items housed within it may not necessarily be required to be of an enlarged length. Therefore, in the case of matches, shown depending in an inverted orientation in FIG. 1, when the housing is in its upright position, the terminal ends are spaced a significant distance from the base portion. This spaced distance can be equal to the length of the matches if so desired.

It will be understood that the items need not be matches. The items may be another type product such as candies, food, preservatives, vitamin pills, etc., which could be packaged in relatively small envelopes.

The match book type assembly housing is a relatively thick material such as a sturdy foldable cardboard. Other type decorative sturdy materials may be used which are structured so as to have fold lines appropriately located in accordance with the foregoing description selected from the class that includes cardboard or thick paper material and plastic, metal, cork, wood or other fiberous sheet material.

What is claimed is:

1. A match book type assembly designed to removably retain and protect a plurality of generally flat items therein, said assembly comprising:

a. housing means having an elongated configuration and secured to said plurality of items and structured for at least partially enclosing and shielding said plurality of items when in a closed position, b. said plurality of items removably mounted on an interior of said housing means and positioned in adjacent relation to one another and collectively disposed in an elongated row extending along a major portion of the length of said housing, c. a mounting portion formed on said housing and extending along the length of said housing means, said plurality of items commonly oriented and secured to said mounting portion at a base end thereof, d. said housing means further comprising a first side flap and a second side flap, said first side flap secured along one longitudinal edge to said mounting portion and extending outwardly therefrom in spaced relation to and on one side of said plurality of items, e. a base portion extending along the length of said housing means and removably secured to correspondingly positioned longitudinal edges of said first and said second side flap in interconnecting relation therebetween, f. said second side flap including a free longitudinal edge selectively disposed into and out of retained engagement with said mounting portion to respectively define said closed position and an open position, g. said base portion comprising a greater transverse dimension than said mounting portion and of sufficient transverse and longitudinal dimension to support said housing in an upright orientation when in a closed position, h. said base portion spaced from correspondingly positioned free ends of said plurality of items and said first and second side flaps extending outwardly in a divergent orientation from said mounting portion to said base portion when said housing means is in said closed position, and i. wherein said first side flap and said second side flap each include an outer surface portion, at least one of said outer surface portions including a photograph secured thereto and extending along a length thereof; said mounting portion on said housing comprising an elongated distal base zone, intermediate zone, and a connector zone, j. said connector zone extending along said one longitudinal edge of said mounting portion and extending outwardly and defining a channel space floor to receive the flat items and said connector zone having an outer edge, k. said intermediate zone being connected to said outer edge and extending along said outer edge and defining an outer surface portion of said housing means when in said closed position and said intermediate zone having an upper edge spaced from said outer edge, l. said distal base zone extending along said upper edge and having a terminal edge extending towards said connector zone and in general, parallel relation to said intermediate zone and together with said intermediate zone defining an outer side wall of said mounting means to receive said free longitudinal edge, and m. said plurality of items being secured to said distal base zone.

2. An assembly as in claim 1 wherein said photograph is dimensioned substantially equal to said one outer surface and is disposed in covering relation thereto and exposed on an exterior of said housing means in a viewable position when said housing means is in either said closed or said open position.

3. An assembly as in claim 1 wherein said outer surface of the other of said second side flaps include informative indicia formed over at least a major portion thereof.

4. An assembly as in claim 1 wherein said items comprise matches and said base portion comprises an outer scratch surface extending along the length of and disposed on the exterior of said base portion, said scratch surface structured to ignite a match head when the match head is moved in frictional engagement therewith, each of said first side flaps and said second side flaps including an outer surface portion, said outer surface of said first side flap including a photograph secured in covering relation thereto and wherein said outer surface of said second side flap includes informative indicia formed over substantially the entire area thereof, whereby advertising may appear on said outer surface of said second side flap and a decorative photograph may appear on said outer surface of said first side flap.

5. An assembly as in claim 4 wherein said plurality of matches each further comprise a match head formed of ignitable material and disposed at and defining a free end thereof, said plurality of match heads spaced from said mounting portion and extending outwardly therefrom towards and in spaced relation to said base portion, said plurality of matches disposed in an inverted orientation when said housing is mounted in said upright orientation supported on said base portion.

6. An assembly as in claim 4 wherein said plurality of matches each further comprise a match head formed of ignitable material, said match head disposed at and defining a free end of respective ones of said matches, said plurality of said match heads spaced from said mounting portion and extending outwardly therefrom towards and in spaced relation to said base portion, said plurality of matches disposed in an inverted orientation when said housing means is maintained in said upright position supported on said base portion.

7. An assembly as in claim 6 wherein said base portion is disposed a spaced distance from said match heads, said spaced distance being at least as great as the length of said matches.

8. An assembly as in claim 1 wherein said base portion comprises a substantially planer configuration disposed transverse to the outward direction of extension of said plurality of matches.

9. An assembly as in class 8 wherein said base is about at least one inch in transverse dimension.

10. An assembly as in claim 1, wherein the housing is of a material selected from the class which includes cardboard, and plastic, metal, cork or wood sheet material and includes foldable hinge means interconnecting side flaps.

* * * * *